US005586400A

United States Patent [19]

Moore, III

[11] Patent Number: 5,586,400

[45] Date of Patent: Dec. 24, 1996

[54] FABRIC HOLDER WITH COMPLIMENTARY CLAMPING SURFACES AND METHOD

[76] Inventor: E. Frank Moore, III, 4447 Old Randleman Rd., Greensboro, N.C. 27406

[21] Appl. No.: 499,231

[22] Filed: Jul. 7, 1995

Related U.S. Application Data

[63] Continuation of Ser. No. 254,071, Jun. 3, 1994, abandoned.

[51] Int. Cl.[6] ..... D06C 3/08; D05B 39/00

[52] U.S. Cl. ..... 38/102.2; 112/103; 160/380

[58] Field of Search ..... 112/103, 121.12, 112/121.15; 38/102.1, 102.91; 160/368.1, 380, 391, 392, 399; 101/127.1; 24/327

[56] References Cited

U.S. PATENT DOCUMENTS

| | | | |
|---|---|---|---|
| 794,414 | 7/1905 | Koepp | 160/399 X |
| 1,093,136 | 4/1914 | Jucker et al. | 38/102.2 |
| 1,758,720 | 5/1930 | Sodergren | 160/392 |
| 3,058,518 | 10/1962 | Housman | 160/380 |
| 4,107,826 | 8/1978 | Tysdal | 160/399 X |
| 4,316,308 | 2/1982 | Chatelain | 160/392 X |
| 4,341,255 | 7/1982 | Mock | 160/368.1 X |
| 4,357,885 | 11/1982 | Stockton | 112/103 |
| 4,495,876 | 1/1985 | Tajima | 112/103 |
| 4,658,522 | 4/1987 | Kramer | 38/102.91 |
| 4,662,038 | 5/1987 | Walker | 160/392 X |
| 4,665,670 | 5/1987 | van den Burg | 160/380 X |
| 5,228,401 | 7/1993 | Moore, III | 112/103 |

FOREIGN PATENT DOCUMENTS

| | | | |
|---|---|---|---|
| 3604725 | 7/1987 | Germany | 38/102.91 |

OTHER PUBLICATIONS

Prior art drawing.

*Primary Examiner*—Ismael Izaguirre

[57] ABSTRACT

A fabric holder and method for maintaining fabric or other flexible planar members in a taut manner for sewing, stitching or embroidering thereon. The fabric is stretched across a portal frame in which the frame sides each have a base with an upward wave-like crest projection. A clamp receptacle receives the projection and fabric thereon to maintain the fabric sandwiched tightly in place. As stresses are applied to the fabric during sewing, the clamp exhibits the ability to rotate outwardly thereby applying a greater gripping force to the fabric to maintain it in place on the frame. After the sewing operation is completed, the clamps can be easily removed for fabric replacement by manually rotating them inwardly, toward the center of the fabric and thereafter lifting the clamp and fabric from the projection.

10 Claims, 3 Drawing Sheets

FABRIC HOLDER WITH COMPLIMENTARY CLAMPING SURFACES AND METHOD

This is a continuation of application Ser. No. 08/254,071, filed 03 June 1994, now abandoned.

BACKGROUND OF THE INVENTION

1. Field Of the Invention

The invention herein pertains to fabric retention during commercial embroidering and sewing and particularly pertains to devices for holding fabric taut during operations thereon by multiple head sewing machines.

2. Description of the Prior Art and Objectives of the Invention

Pantograph-like devices are frequently used on commercial multi-head sewing machines whereby emblems, logos, names and other designs are simultaneously applied to a number of shirts, jackets or to previously unsewn fabric. U.S. Pat. No. 5,228,401 demonstrates a sewing apparatus having a T-shaped pantograph which for example can be used with a rectangular frame to hold fabric on all sides during stitching or embroidering. U.S. Pat. No. 4,495,876 demonstrates a rectangular frame for holding cloth in place during multiple head sewing operations. Prior fabric holding frames have employed different methods to maintain fabric taut and certain manufacturers employ a conventional frame device as shown in FIG. 5 herein which utilizes a bulbous projection and a removable spring steel clamp. In use, the edges of the fabric to be stitched are placed over the bulbous projection around the frame and several spring steel clamps which may each be a few centimeters in length are urged over the fabric laden projection to maintain the cloth on the frame. The spring steel clamp and radius of the projection are designed whereby the clamp can be removed and replaced manually on the projection quickly by inexperienced sewing personnel, yet tight enough to adequately secure the fabric edges under adverse sewing conditions. As would be understood, in commercial operations, twelve or more sewing heads may operate in unison on the fabric which is stretched over the frame and in many patterns, tremendous pressure is applied by lock stitching thousands of stitches in a very small space. Thus, extreme pressure is applied to the fabric, sometimes, actually pulling the clamps free of the fabric and projection. When this occurs the sewing operation must be stopped and oftentimes the entire pattern resewn on new fabric with great loss of time, labor and materials. If clamps are designed to securely hold the fabric under the most adverse sewing conditions as frequently occur, the clamps are generally impossible for the average worker to manually, easily remove and replace when needed. Hence a dilemma exists in fabricating the spring steel clamps to provide enough tension to properly hold the fabric, but allowing sufficient resiliency for manual removal when replacing the fabric for the next cycle. Another concern for manufacturers of standard fabric holders relates to the particular fabric being sewn. Certain fabrics are thicker than others and the tension of the spring steel clamp must be such that it will sufficiently hold both thick and thin fabrics. The clamp manufacturer must insure adequate clamp tension to securely hold the fabrics yet the sewing machine operators must manually, quickly remove and replace the clamps at the beginning of each stitching cycle.

Thus with the disadvantages and problems associated with prior fabric holding devices, the present invention was conceived and one of its objectives is to provide a fabric holder for multi-head sewing machines and a method which grants secure fabric retention and easy manual usage by relatively unskilled personnel.

It is still another objective of the present invention to provide a means for holding fabric which includes a wave-like crest projection and a clamp with a complementary receptacle for receiving the wave-like crest projection and fabric therein.

It is yet another objective of the present invention to provide a frame for a multi-head sewing machine which utilizes the fabric holder as immediately described above.

Various other objectives and advantages of the present invention will become apparent to those skilled in the art as a more detailed description is set forth below.

SUMMARY OF THE INVENTION

The invention herein pertains to a fabric holder and method including a rectangular frame having an upward projection in the shape of a wave-like crest therearound. The wave-like crest is biased inwardly towards the center of the frame and a complementary clamp holds the edge of fabric placed thereon against the crest projection. Fabric is placed over the wave-like crest projection and a plurality of relatively short clamps are then positioned around the frame, over the projection with the fabric therebetween. Under adverse sewing conditions, as more and more pressure is applied to the fabric within the frame, such pressure causes the clamps to rotate on the projecton outwardly, thereby tightening the clamps and fabric against the projection and preventing the clamps from loosening and inadvertent clamp ejection. Once the sewing operation is completed a gripping tab on the clamp can be used to rotate it inwardly for quick and easy removal with very little hand pressure required. A new fabric is thereafter loaded onto the frame as before, the clamps replaced and the sewing operation is ready to begin anew.

DETAILED DESCRIPTION OF THE PREFERRED EMBODIMENT AND OPERATION OF THE INVENTION

Figure 1:
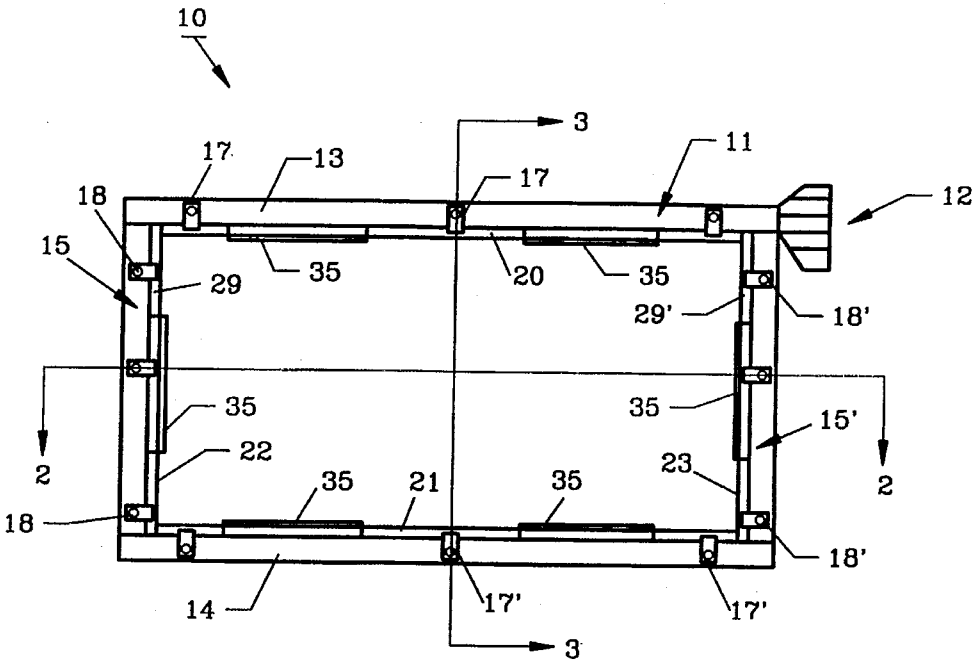
FIG. 1 demonstrates a top plan view of a commercial multi-head sewing machine pantograph with a fabric holder of the invention attached thereto.

For a better understanding of the invention and its method of operation, turning now to the drawings, FIG. 1 shows a top view of a preferred form of rectangular portal fabric holder 10 which includes T-shaped pantograph 11 having a drive end 12 which is joined to conventional multi-head sewing machine controls (not shown). As would be understood, portal fabric holder 10 is used on a conventional multi-head sewing machine and may for example be used on a twelve head, high speed machine for sewing or embroidering fabric with twelve labels or logos simultaneously. Fabric holder 10 is made from aluminum and includes rear frame member 13, front frame member 14, left side frame member 15 and right side frame member 15' which are joined together at their terminal ends to form a rectangular fabric frame. Affixed internally to frame members 13, 14, 15 and 15', are extruded rear frame base 20, front frame base 21, left frame base 22 and right frame base 23, also seen in FIG. 1. Frame bases 20–23 are solid aluminum extrusions which are affixed to their respective frame members 13, 14, 15, 15' by rear frame bracket 17, front frame bracket 17', left frame bracket 18 and right frame bracket 18'. In FIGS. 3A–3F, which are taken along lines 3—3 of FIG. 1, rear frame bracket 17 is shown affixed to rear frame base 20 and to rear frame member 13. Rear frame bracket 17 is affixed by screws or other suitable means (not shown) to rear frame member 13.

Figure 4:
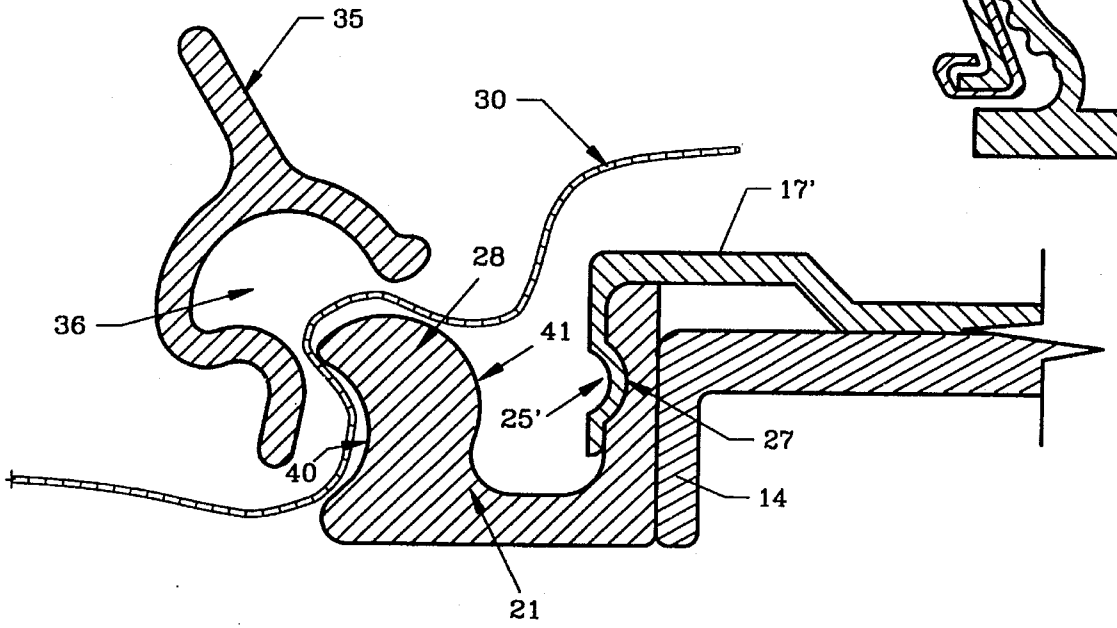
FIG. 4 features an enlarged cross-sectional view of one part of the fabric holder with fabric and the clamp at initial application.

As better seen in enlarged FIG. 4, front frame bracket 17' comprises a bracket protrusion 25' which engages longitudinal notch 27 of front frame base 21. Frame bracket 17' is formed of durable spring steel to securely, resiliently hold front frame base 21 to front frame meanbet 14. As would be understood, rear frame base 20, left frame base 22 and right frame base 23 are likewise affixed to their respective frame members 13, 15 and 15'.

As further shown in FIG. 4, front frame base 21 includes an upward base male mating projection 28 which has a somewhat curled asymmetrical wave-like crest configuration. Wave-like crest male mating projection 28 is pointed or biased inwardly, towards the center of portal fabric holder 10 as shown in FIG. 1. The outer surface of fabric clamp 35 defines complementary female mating receptacle 36 for surrounding and engaging wave-like crest projection 28. Clamp 35 is a few inches in length as desired and is formed from a durable plastic such as polystryene having a degree of flexibility to allow easy placement over projection 28 with fabric 30 thereon. As clamp 35 is positioned over projection 28 fabric 30 is tightened as clamp 35 is rotated clockwise (FIG. 4) as better shown in progressive phases in FIGS. 3A–3F. Multiple clamps 35 are used around fabric holder 10 as needed and in FIG. 1, six clamps 35 are seen.

Figure 2:
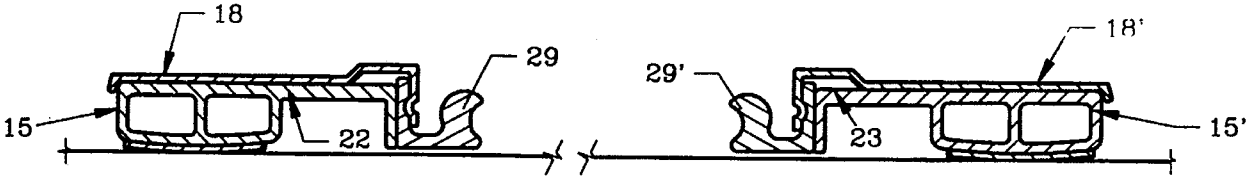
FIG. 2 shows a cross-sectional shortened view of the fabric holder along lines 2—2 of FIG. 1 without clamps or fabrics thereon.
Figures 3A, 3B, 3C, 3D, 3E, 3F:
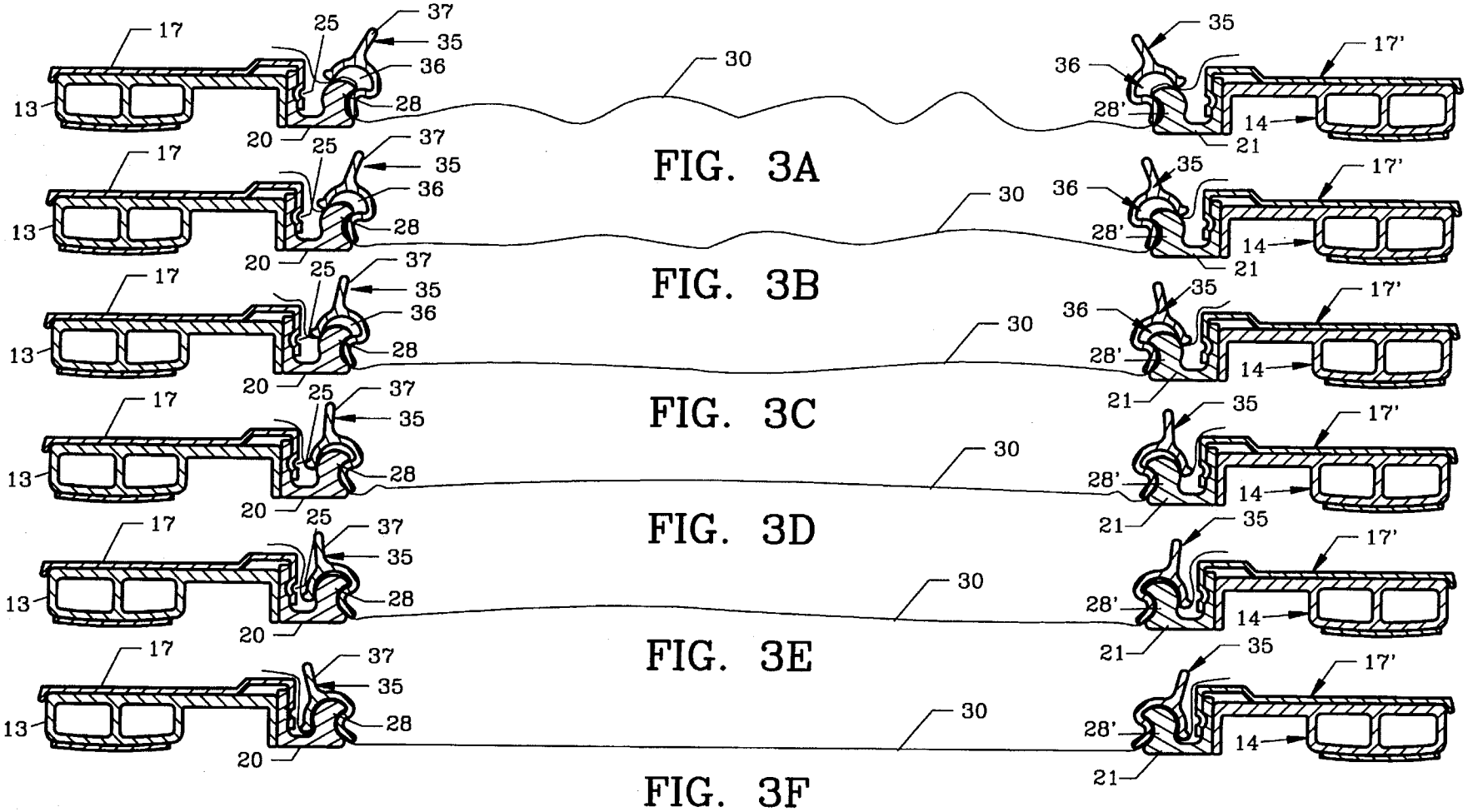
FIG. 3A–3F depicts a cross-sectional view along lines 3—3 of the fabric holder of FIG. 1 in progressive stages with fabric placement thereon.
Figure 5:
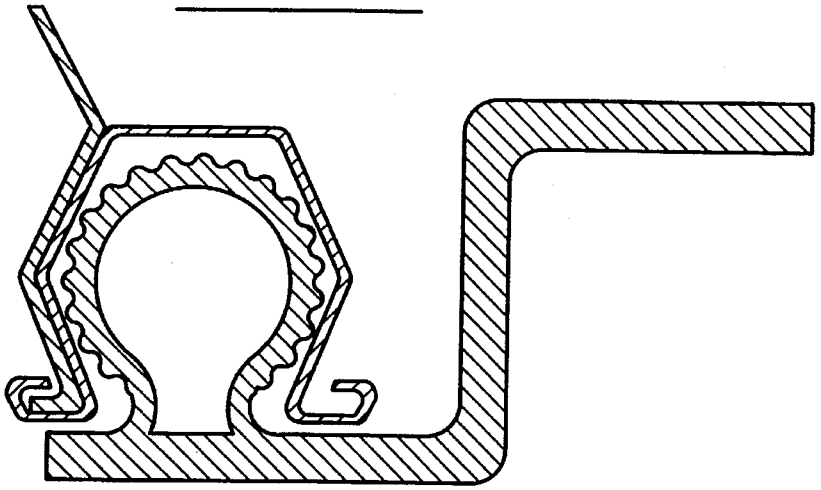
PRIOR ART FIG. 5
FIG. 5 presents a cross-sectional view of part of a conventional fabric holder and clamp.

In FIG. 3A, left and right clamps 35 are partially placed on wave-like crest projections 28, 28' and as they are manually rotated outwardly, as seen in FIGS. 3A–3F, away from the center of portal fabric holder 10, fabric 30 is tensioned to provide a taut planar member for sewing and embroidering thereon. This manual cam-like rotation of clamps 35 requires little finger strength yet results in a firm, tight holding of fabric 30. As hereinbefore explained, during adverse sewing conditions where thousands of lock stitches are sewn in one pattern, fabric 30 is pulled from all sides and also into the pattern causing extreme stress to fabric 30. At such times, with fabric 30 so stressed, clamps 35 rotate outwardly, or tighten as fabric 30 is pulled inwardly, thereby securing fabric 30 even more so on projections 28, 28' (FIGS. 3A–3F), 29, 29' (FIG. 2) during such periods. This ability of clamps 35 to rotate outwardly affords a self-locking effect. Hence, as more stress is applied to fabric 30 during sewing, the tighter clamps 35 hold fabric 30 in place. In FIG. 2 frame base projections 29, 29' are pictured without fabric 30 and with clamps 35 removed therefrom for clarity purposes.

Once the stitching or embroidering pattern is complete on fabric 30, the sewing machine operator can simply urge gripping tabs 37 of clamps 35 inwardly as progressively shown in FIGS. 3F–3A and with very little manual force needed and thereafter remove clamps 35. Fabric 30 is then removed from frame bases 20–23. An unsewed fabric 30 can then be applied to frame base 20–23, clamps 35 repositioned and the sewing operation begun anew. Various designs of portal frames, hoops, pantographs and the like can be developed utilizing a base with a wave-like crest projection as demonstrated herein which includes a concave section shown at 40 and a convex section 41 as seen in FIG. 4 which, in conjunction with clamp 35 provides "self-tightening" of the fabric during sewing.

The illustrations and examples provided herein are only for explanatory purposes as those skilled in the art can develop other portal frames, pantographs or the like for holding fabric without departing from the spirit of the described invention. The examples are not intended to limit the scope of the appended claims.

I claim:

1. A means for securing a flexible planar member in a taut manner for subsequent sewing operations on a sewing machine comprising: a base and a clamp, said base comprising a vertical male mating projection, said vertical projection having a single convex section and a single concave section on opposite sides of said vertical projection, said clamp having an outer surface, said clamp outer surface defining a complementary female mating receptacle, said complementary female mating receptacle for rotatingly tightening around said convex section and said concave section wherein said complementary female mating receptacle fully encloses said male mating projection to sandwich said flexible planar member therebetween.

2. The means of claim 1 including a gripping tab, said gripping tab projecting outward from the middle of said clamp opposite said female mating receptacle.

3. The means of claim 1 wherein said male mating projection is asymmetrical along its vertical axis.

4. A fabric frame for securing a cloth on a sewing machine in a taut manner for subsequent sewing thereon, said base comprising an asymmetrically curled vertical projection, said vertical projection having a convex section and a concave section on opposite sides of said vertical projection, said clamp comprising a complementary female mating receptacle to tightly receive and fully enclose said asymmetrically curled vertical projection, wherein said cloth is sandwiched between said female mating receptacle and said convex section and said concave section with said cloth fully enclosing and continuously contacting said vertical projection and said complementary female receptacle.

5. A method of securing a flexible planar member to a base having an asymmetrically curled vertical wave-like crest projection having a convex section and a concave section on opposite sides of said vertical projection, with a female mating clamp to maintain the flexible planar member for subsequent sewing on a sewing machine, comprising the steps of:

(a) placing the flexible planar member over the convex section and the concave section; and (b) positioning the female mating clamp on the flexible member contiguous to said vertical wave-like crest projection wherein said flexible planar member is sandwiched between and in continuous contact with said female mating clamp and said vertical wave-like crest projection.

6. The method of claim 5 and including the steps of rotating the clamp on the vertical wave-like crest projection with the flexible planar member sandwiched therebetween.

7. The method of claim 6 wherein rotating the clamp comprises the step of tightening the clamp onto the vertical wave-like crest projection.

8. The method of claim 6 wherein said clamp is polymeric, and including the step of rotating said polymeric clamp onto the vertical wave-like crest projection of the base.

9. A pantograph comprising a rectangular base, an asymmetrically curled vertical wave-like crest projection, said projection extending from said base and having a concave vertical side and an opposing convex vertical side, a complementary female mating clamp, said clamp for surrounding said projection to secure a planar member in continuous contact with said projection.

10. The pantograph of claim 9 and including a gripping tab, said gripping tab joined to said clamp.

* * * * *